United States Patent [19]

Pozzobon et al.

[11] Patent Number: 4,787,124

[45] Date of Patent: Nov. 29, 1988

[54] MULTIPLE-FUNCTION ACTUATION DEVICE PARTICULARLY USABLE IN SKI BOOTS

[75] Inventors: Alessandro Pozzobon, Paderno di Ponzano Veneto; Roberto Gorza, Feltre, both of Italy

[73] Assignee: Nordica S.p.A., Montebelluna, Italy

[21] Appl. No.: 96,193

[22] Filed: Sep. 14, 1987

[30] Foreign Application Priority Data

Sep. 23, 1986 [IT] Italy ..... 82577 A/86
Sep. 23, 1986 [IT] Italy ..... 82578 A/86
Nov. 25, 1986 [IT] Italy ..... 59488/86[U]

[51] Int. Cl.[4] ..... A43B 5/04
[52] U.S. Cl. ..... 24/68 SK; 36/50
[58] Field of Search ..... 24/68 SK, 68 R; 36/50; 254/306, 310, 321; 242/107.6

[56] References Cited

U.S. PATENT DOCUMENTS 1,092,669 4/1914 Smith ..... 254/310
2,535,318 12/1950 Ratcliffe ..... 254/306
4,433,456 2/1984 Baggio ..... 36/50
4,449,273 5/1984 Baggio ..... 36/50
4,616,524 10/1986 Bidoia ..... 36/50
4,619,057 10/1986 Sartor et al. ..... 24/68 SK
4,631,839 12/1986 Bonetti et al. ..... 24/68 SK
4,633,599 1/1987 Morell et al. ..... 24/68 SK
4,653,204 3/1987 Morell et al. ..... 24/68 SK

*Primary Examiner*—Victor N. Sakran
*Attorney, Agent, or Firm*—Guido Modiano; Albert Josif

[57] ABSTRACT

Multiple-function actuation device for ski boots, consisting of a containment body associable with a ski boot and supporting an actuation assembly for the actuation of at least one drive shaft kinematically connected at least to a first winder and to a second winder for a traction element connected to at least one movable element of the boot. Means for kinematic switching are adapted to kinematically connect the actuation assembly alternately to the first winder or to the second winder mans for the releasable locking of the rotation in the direction of unwinding are applied to the winders.

17 Claims, 7 Drawing Sheets

Fig. 7
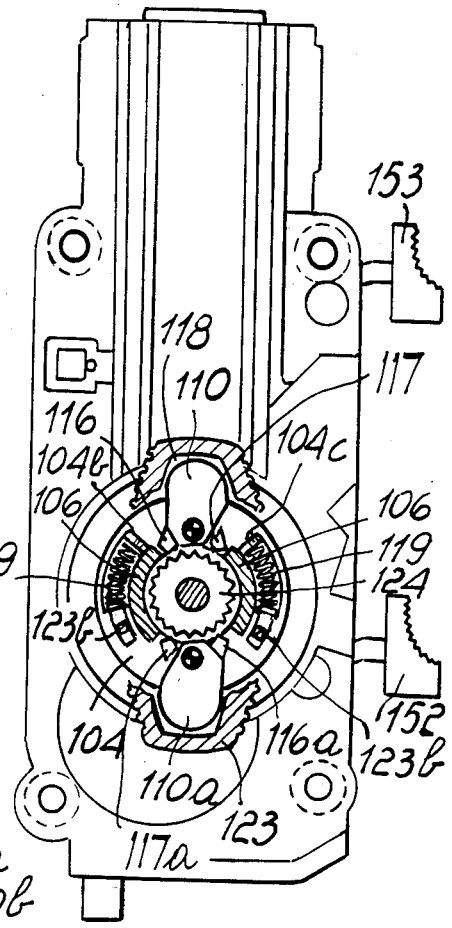
Fig. 6
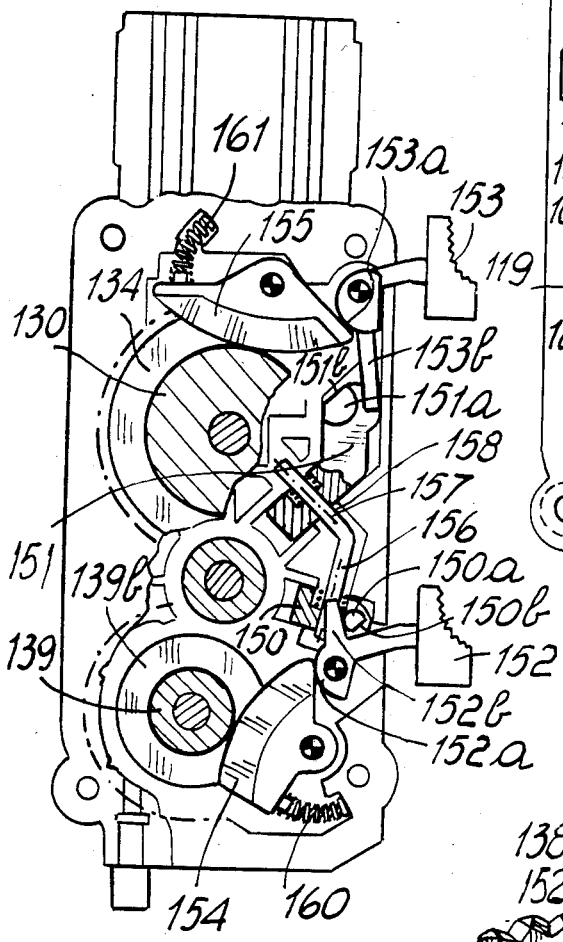
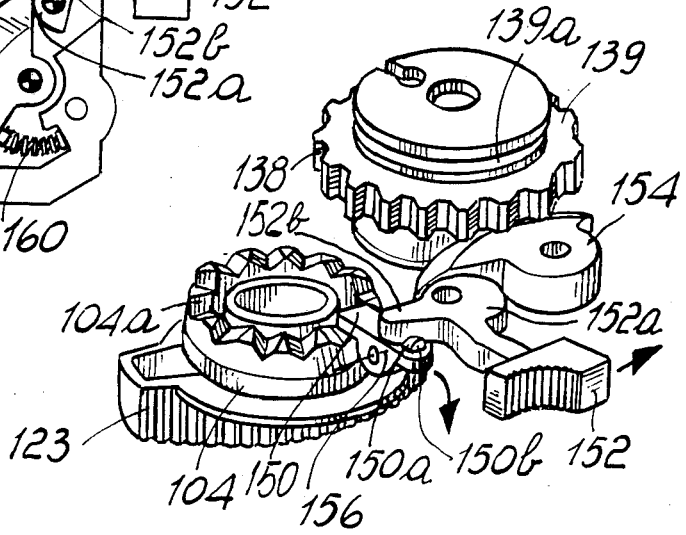
Fig. 5

MULTIPLE-FUNCTION ACTUATION DEVICE PARTICULARLY USABLE IN SKI BOOTS

BACKGROUND OF THE INVENTION

The present invention relates to a multiple-function actuation device particularly usable for ski boots.

The use is currently known in ski boots of devices which allow the closure of the quarters, the tightening of a presser at the regions of the instep of the foot or of the heel or other normally required functions.

Thus, if it is desired to perform two or more of said actuations simultaneously, known boots have individual actuation means for each required function, thus entailing considerable problems as to the positioning of the various devices on said boot.

As a partial solution to this disadvantage, the same Applicant filed a patent application, U.S. Ser. No. 06/946,240, related to a multiple-function actuation device.

Said device comprises a containment body associable with a ski boot and supporting a lever which can be operated from outside and is operatively connected, with a ratchet assembly interposed, to a central shaft rotatably supported by said containment body.

Said device furthermore comprises a selector which can be operated from the outside of the containment body and is selectively engageable with a first adn with at least a second winding pulley, respectively, for a first and for a second cable and the like.

Though said solution is undoubtedly valid, the following disadvantages are observed: initially the user must select the desired function by means of the selector, then the first and the second pulleys each wind up an equal length of cable, for an equal given rotation of the central shaft.

If the cables must be adjusted differently the operator may have to act on the lever several times in order to obtain the desired adjustment for each function.

SUMMARY OF THE INVENTION

The aim of the present invention is to eliminate the above mentioned disadvantage by providing a device which, together with centralizing all the necessary functions in one element, allows a differentiated winding of the cables, bands or similar elements acting, for example, on a foot presser and on the ski bott quarters.

Within this aim a scope of the invention is to provide a device that allows an independent and separate adjustment of each function without the need of any previous selection.

A further scope of the invention is to provide a compact device such that it can be arranged on the ski boot in a most favourable position easily reached by the operator for its actuation.

A not less important scope is to provide a structurally simple device.

The mentioned aim and objects, as well as others which will become clear later, are achieved by a multiple-function actuation device, particularly for ski boots, comprising a containment body associable with a ski boot and supporting an actuation assembly for the actuation of at least two traction elements, each connected to at least one movable element of said boot, characterized in that said actuation assembly actuates at least one drive shaft kinematically connected at least to a first winder and to a second winder for a traction element, means for kinematic switching being provided to kinematically connect said actuation assembly alternately to said first winder and to said second winder, means being furthermore provided for the releasable locking of the rotation in the direction of unwinding of said first winder and of said second winder.

BRIEF DESCRIPTION OF THE DRAWINGS

Further characteristics and advantages of the invention will be more clearly set forth from the description of some particular, but not exclusive, embodiments, illustrated only by way of non-limitative example in the accompanying drawings, wherein:

FIG. 5 is a partial schematic perspective view of the arrester means and of the releasably locking means of the device of FIG. 3;

FIG. 6 is a front cross section view along the line VI—VI of FIG. 3;

FIG. 7 is a front cross section view along the line VII—VII of FIG. 3;

DESCRIPTION OF THE PREFERRED EMBODIMENTS

Figure 1:
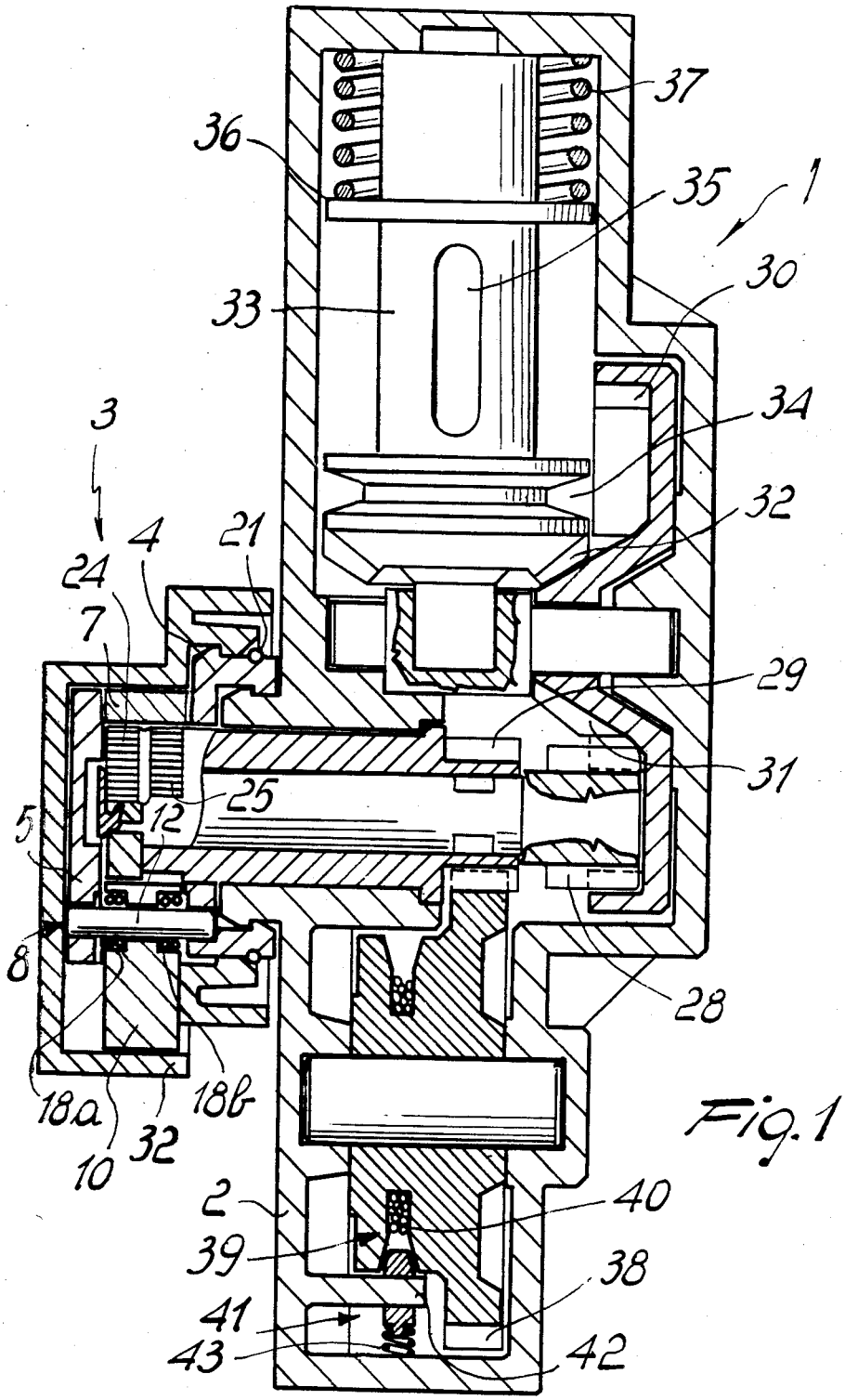
FIG. 1 is a lateral elevation view, in partial cross section, of the device according to the invention, the cross section of the actuation assembly being along two mutually perpendicular axes.
Figure 2:
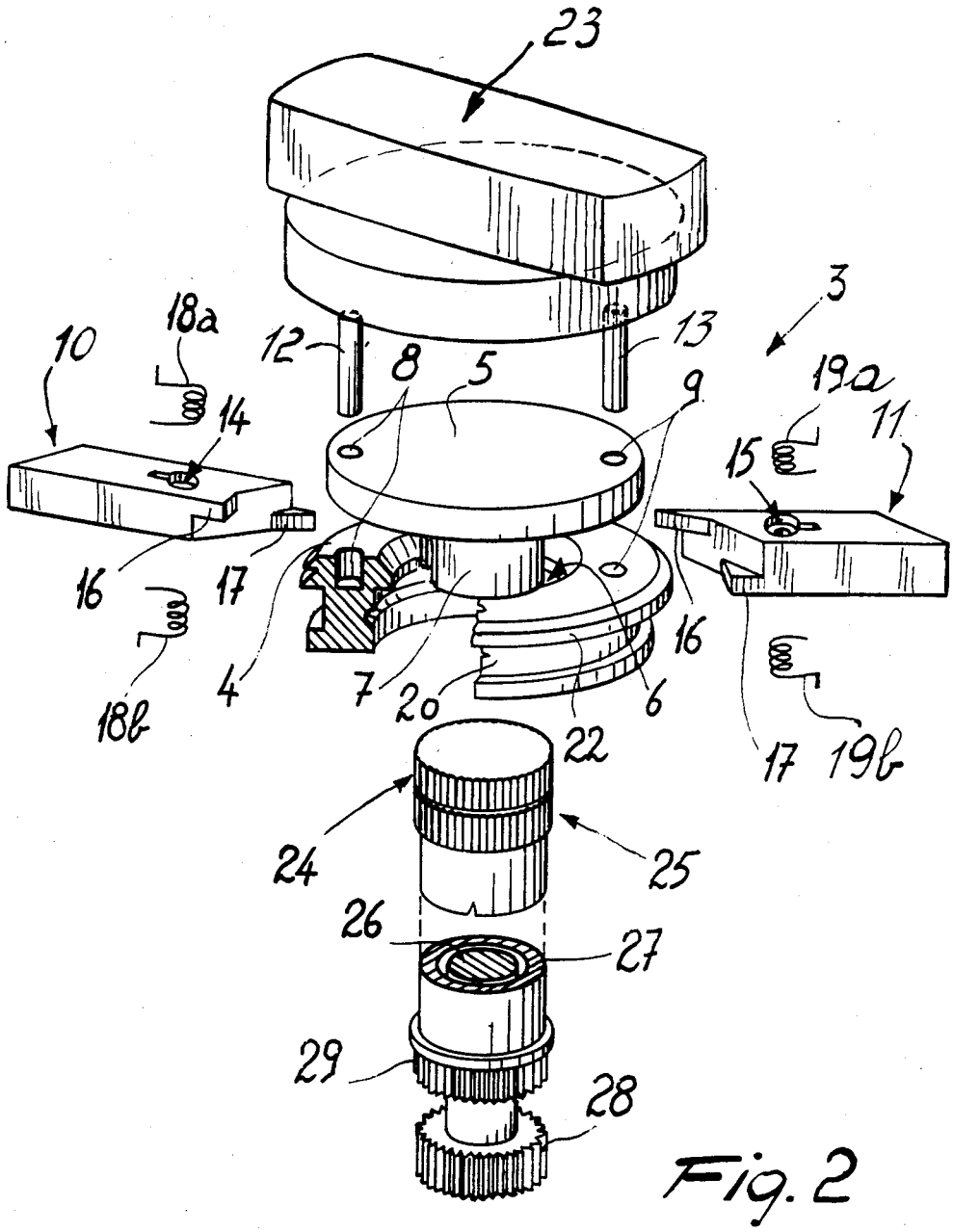
FIG. 2 is an exploded view of the actuation assembly and of the first and second drive shafts.
Figure 4:
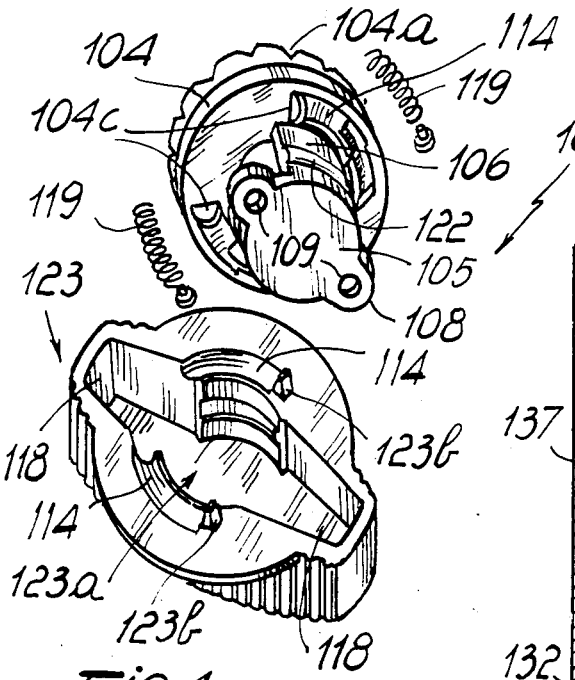
FIG. 4 is an exploded view of a detail of the actuation assembly of the device of FIG. 3.

With reference to FIGS. 1 and 2, the multiple-function actuation device, generally indicated by the reference numeral 1, comprises a containment body 2 which is supported for example at the rear region of the rear quarter of a ski boot.

An actuation assembly 3 is associated with the containment body 2 in a snap-together manner and consists of a first base 4 and of a second base 5, essentially cylindrical in shape, said first base being provided with an axial hole 6.

A pair of spacers 7, arranged diametrally with respect to the hole 6, keep said bases 4 and 5 parallel to one another, on each of said bases there being provided, on a plane perpendicular to the one passing through said spacers, two pairs of through holes 8 and 9, the holes of each pair having the same axis, which is parallel to that of the axial hole 6.

A first fin 10 and a second fin 11 are insertable in the interspace not occluded by said spacers 7, between the facing surfaces of said bases 4 and 5, and are arranged radially with respect to said bases and are pivoted thereto by means of adapted pivots 12 and 13 equal in diameter to the holes 8 and 9 as well as to the holes 14 and 15 provided on the fins perpendicularly with respect to their longitudinal middle axis.

Said fins are provided, at the respective facing surfaces, with a pair of small teeth, indicated by the numerals 16 and 17, which are located on the planes of arrangement of the surface of the fin which faces respectively towards the second base 5 and towards the first base 4.

Said teeth protrude beyond the facing ends of said fins, and are connected thereto along a portion arranged approximately at 45° in the direction of the longitudinal middle axis of the fins.

Said portions arranged at 45° are arranged approximately at the plane of arrangement of the perimetral border of the axial hole 6 provided at the first base 4.

In order to keep both fins 10 and 11 in neutral position at rest, that is to say with their longitudinal axis arranged at the diametral axis of the bases 4 and 5, springs, indicated respectively by the numerals 18*a*, 18*b* and 19*a*, 19*b*, are interposable between the fins and said bases.

An annular seat 20 is provided on the lateral surface of the first base 4 for a small ring 21 adapted to keep said base 4 coupled to the containment body 2.

Also at the lateral surface of the first base 4, an annular lug 22 is furthermore provided for the snap-together coupling of the end of a knob 23 which covers, in use, both the acutation assembly 3 and the fins 10 and 11.

The first ends, respectively 24 and 25, of a first shaft 26 and of a second shaft 27, coaxial to the first, are arrangeable at the hole 6.

Said two shafts are mutually freely rotatable, the ends 24 and 25 having a substantially cylindrical shape with the knurled lateral surfaces respectively facing the teeth 16 and 17 of the fins 10 and 11.

Said first shaft and said second shaft are respectively provided, at the opposite end with respect to said first ends, with a first gearwheel 28 and with a second gearwheel 29.

Said first gearwheel 28 meshes with a first toothed wheel 30 freely pivoted in the containment body 2; a first conical gear 31 is keyed on the pivoting axis of said first wheel and cooperates with a second conical gear 32 rigidly associated with a winder.

Said winder consists of a third shaft 33, substantially cylindrical in shape, rotatably associated inside the containment body 2 and arranged along a longitudinal axis which is perpendicular to that of said shafts 26 and 27.

Adjacent ot the conical gear 32, the shaft 18 is provided with an annular groove 34 and with a through transverse seat 35 for a band which is insertable therein and is adapted, for example, to provide the mutual closure of the quarters.

Beyond said seat 35, in the opposite direction with respect to the groove 34, an annular ridge 36 is provided on the shaft 33, between the latter and the base of the containment body 2 there being provided a spring 37 the ends whereof are associated with said containment body and with the ridge.

The second gearwheel 29 rigidly associated with the second shaft 27 meshes instead with a second toothed wheel 38 freely pivoted to the containment body 2, with said second wheel there being rididly associated a pulley 39 for winding, for example, a cable 40.

Means for the releasably locking of the rotation in the direction of unwinding of said band and of said cable, consisting for example of a brake 41, illustrated for the sake of simplicity applied only to the pulley 39.

The brake 41 is eccentrically pivoted to a pivot 42 which projects inside the containment body 2, said brake being provided with a lateral surface which is complementary to the walls of the groove of the pulley and is forced to interact with said walls by means of an adapted spring 43.

Said brake allows the winding of the cable 40, preventing its unwinding. The brake can be furthermore disengaged from the outside by means of a lever, not illustrated herein for the sake of simplicity.

The operation of the device is as follows: by rotating the knob 23 in a clockwise direction, the small teeth 17 are caused to interact with the knurled lateral surface of the end 25 of the second shaft 27, during this step the fins 10 and 11 arranging themselves along an axis which is inclined with respect to the diametral one of the hole 6, since the inner walls of the knob 23 act on the faces of the fins 10 and 11 which are opposite to the teeth 16 and 17, forcing the fins 10 and 11 to rotate about their own pivots 12 and 13.

The further rotation of the knob 23 then causes the rotation of the shaft 27 and therefore of the gearwheel 29 thereof, which, by virtue of the second toothed wheel 38, allows the winding of the cable 40 on the pulley 39.

Instead, by performing an anticlockwise rotation of the knob 23, the fins 10 and 11 arrange themselves so as to allow the interaction of the teeth 16 with the knurled surface of the end 24 of the first shaft 26, the subsequent further rotation of the knob causing the rotation of the gearwheel 28 which, by means of the first toothed wheel 30 and of the conical gears 31 and 32, transmits the motion to the shaft 33 of the winder, allowing the winding of the band.

During this step, the pulley 39 is inactive since the shaft 27 is not actuated.

The reverse rotation, that is to say in the direction of unwinding, of the pulley 39 and of the shaft 33, is prevented by the presence of the brake 41; thus, in order to take the boot off, it is sufficient to act on the brakes 41 so as to free the pulley 39 and the shaft 33, allowing the rotation thereof in the direction of unwinding.

FIGS. 3–7 illustrate a device 101 according to another aspect of the invention, comprising a containment body 102 which is associable with a ski boot for example at the rear quarter. The containment body 102 supports an inner shaft 126 and an outer shaft 127 which is coaxial and freely rotatable with respect to the inner shaft 126, said shafts acting respectively on a drum 133 having a vertical axis and on a pulley 139 having a substantially horizontal axis of rotation (with reference to FIG. 3).

More in particular: the inner shaft 126 is provided, at its right end, with a first gearwheel 128 which meshes with a toothed wheel 130 provided with a groove 134 and with a conical set of teeth 131 which meshes with a conical gear 132 keyed to the drum 133. The outer shaft 127 is provided, at its right end and adjacent to the first gearwheel 128, with a second gearwheel 129 which meshes with a set of teeth 138 provided on the pulley 139 in an intermediate position between a first groove 139*a* and a second groove 139*b* of said pulley.

The pulley 139 can be used, for example, to wind a cable (not illustrated) on the groove 139*a*, acting on a foot presser in a per se known manner.

The drum 133 can instead be used to wind a band (not illustrated) which is adapted to achieve the closure of the quarters and is connectable to the drum by means of an axial slit 135. A helical spring 137 is furthermore provided on the drum 133 in order to facilitate a first winding of the band on the drum during the closure of the quarters in a per se known manner.

The acutation assembly 103, advantageously applied in a snap-together manner to the containment body 102, is arranged at the left ends of the coaxial shafts 126 and 127.

The actuation assemlby 103 comprises a supporting ring 104 provided with an external raised portion 104*b* for its association in a snap-together manner with the containment body 102, allowing its rotation; the ring 104 is furthermore provided with an annular seat 120 for a cylindrical helical spring 121 which pushes the ring 104 into abutment with the containment body 102 at the raised portion 104*b*.

The ring 104*b* is provided with the cylindrical sectors 106, which have a ridge 122 for the snap-together connection to a knob 123, in a cylindrical seat 123*a* whereof, which accommodates said sectors so as to allow an at least partial rotation of the knob 123 with respect to the ring 104.

The cylindrical sectors 106 are closed, on the side opposite to the ring 104, by a base 105 provided with tabs 108 arranged diametrally opposite and in an intermediate position between the sectors 106.

The tabs 108 are arranged inside respective trapezoidal seats 118 provided in diametrally opposite positions in the knob 123 at the cylindrical seat 123*a*. The tabs 108 are each provided with a hole 109 for respective pivots 112 whereto are pivoted a first pair of fins 110 and 110*a* and a second pair of fins 111 and 111*a* accommodated in the trapezoidal seats 118 of the knob.

The fins 110 and 110*a* are arranged in diametrally opposite positions and each is provided with a tooth 116 at a first toothed wheel 124 rigidly associated with the left end of the inner shaft 126.

Similarly, the fins 111 and 111*a* are arranged respectively superimposed on the fins 110 and 110*a* and are also provided each with a tooth 117 at a second toothed wheel 125 rigidly associated with the outer shaft 127.

In this manner, by rotating the knob 123 in an anticlockwise direction, with reference to FIG. 7, the fins 110 and 110*a* are caused to rotate about the pivots 112 so that the teeth 116 mesh with the toothed wheel 124; by further rotating the knob 123 in the same direction, the inner shaft 126 and thus the drum 133 are actuated. Since the fins 111 and 111*a* have the teeth 117 in counterposed positions with respect to the teeth 116, the toothed wheel 125 is not engaged by the teeth 117 of the fins 111 and 111*a*. In order to engage the toothed wheel 125 and thus impart a rotation to the outer shaft 127, it is sufficient to rotate the knob 123 clockwise, again with reference to FIG. 7; in a similar manner, the teeth 116 do not engage, in this case, the toothed wheel 124.

In order to keep the actuation assembly 3 in a neutral position, illustrated in FIG. 7, that is to say with neither of the pairs of teeth 116 and 117 engaging their respective toothed wheels, elastic means are provided and advantageously consist of the cylindrical helical springs 119 accommodated in diametrally opposite seats 114 in the shape of a toroidal sector defined between the facing surfaces of the knob 123 and of the ring 104, in positions adjacent to the cylindrical sectors 106.

The springs 119 act in opposite directions between the abutments 123*b* of the knob 123 and the abutments 104*c* of the ring 104.

The drum 133 and the pulley 139 are provided with means for locking the rotation in the direction of unwinding in order to lock the traction elements (band and cable) in the desired position.

In particular, the pulley 139 is provided with a groove 139*b*, arranged laterally with respect to the set of teeth 138, and engageable by a first brake 154 eccentrically pivoted to the containment body 102.

Figure 3:
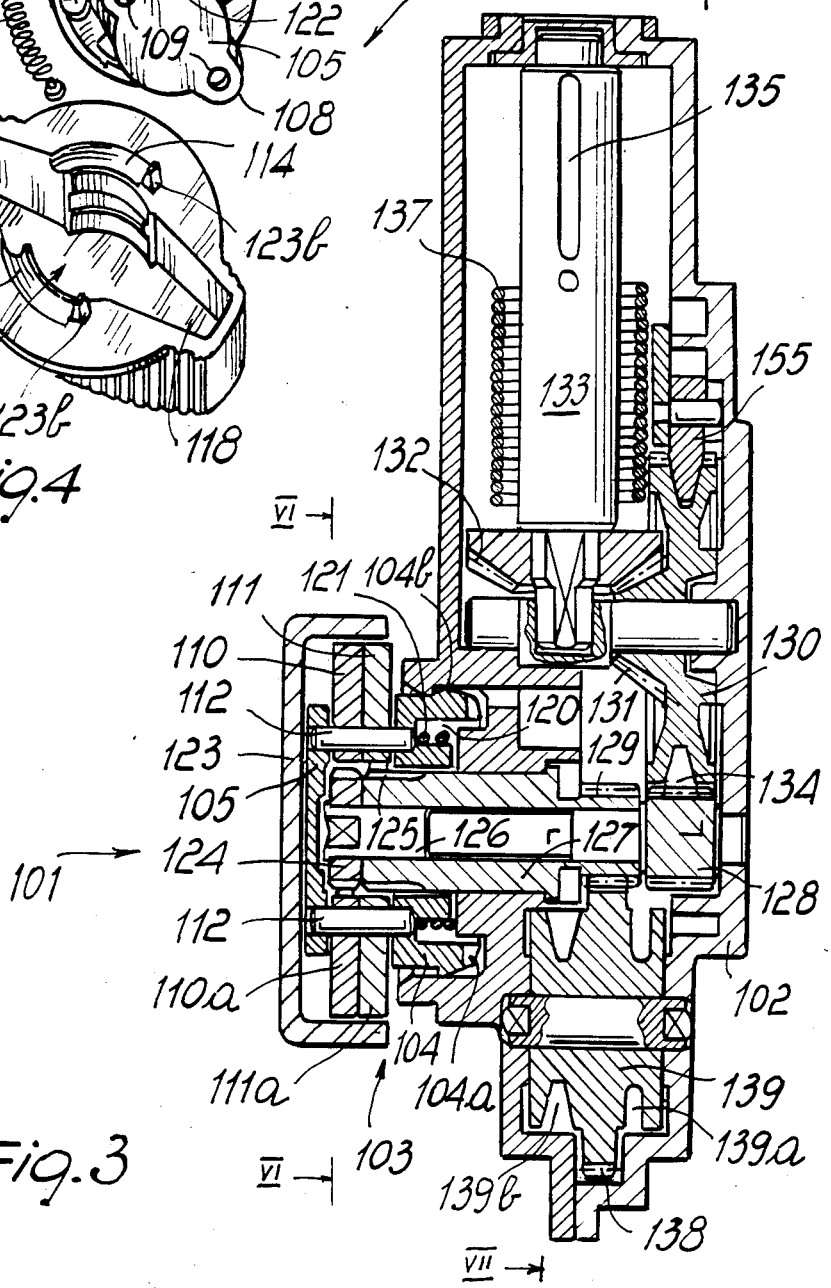
FIG. 3 is a lateral elevation view, in cross section, of a device according to another aspect of the invention.

The brake 154, illustrated in FIGS. 5 and 6 but not in FIG. 3 for the sake of clarity, is provided with a substantially pentagonal profile complementary to the inner profile of the groove 139*b* and is eccentrically pivoted so that a rotation of the pulley 139 in an anticlockwise direction, that is to say in the direction of unwinding, pushes the brake 154 inside the groove 139*b*, blocking any further rotation of the pulley due to the friction between the walls of the groove 139*b* and the outer walls of the brake 154. Advantageously, an elastic element such as the spring 160 is provided to facilitate the engagement of the brake 154 with the groove 139*b*.

The locking means for the drum 133 comprise a second brake 155 advantageously applied to a groove 134 provided on the toothed wheel 130, preventing its clockwise rotation with reference to FIG. 6; the spring 161 acts on the brake in a manner similar to the one previously described.

The means for locking the rotation of the pulley 139 and of the drum 133 are provided with actuation means to allow the unwinding of the traction elements connected thereto. THe actuation means comprise a first pushbutton 152, accessible from outside, which is pivoted to the containment body 102 and has a cam 152*a* acting on the first brake 154 so that by pushing the pushbutton 152 downwards (FIG. 6) the cam 152*a* acts on the brake 154, moving it away from the groove 139*b*.

Similarly, a second pushbutton 153 acts, by means of the cam 153*a*, on the brake 155 to unlock the toothed wheel 130 and therefore the drum 133.

Advantageously, arrester means are provded to keep the pushbuttons 152 and 153 in the position of release of the respective brakes 154 and 155. The arrester means comprise, with particular reference to FIG. 6, a front set of teeth 104*a* provided on the ring 104 and oscillating teeth 150 and 151 respectively provided with the hemispherical protrusions 150*a* and 150*b* interacting with the tabs 152*b* and 153*b* of the pushbuttons 152 and 153.

The oscillating teeth 150 and 151 are respectively pivoted to the axes 156 and 157 defined by the angular pivot 158 rigidly associated with the containment body 102.

With particular reference to FIG. 5, by acting on the pushbutton 152 in the direction of the arrow A, that is to say towards the right, the brake 154 is released in the manner described above and simultaneously the tab 152*b* passes beyond the hemispherical protrusion 150*a* of the oscillating tooth 150 since the latter is pivoted to the axis 156.

When the tab 152*b* has passed beyond the hemispherical protrusion 150*a*, the oscillating tooth 150 returns to its normal position by virtue of an elastic element, such as for example a spring, not illustrated for the sake of simplicity; the pushbutton 152 thus remains in the release position, since the tab 152*b* abuts with the abutment surface 150*b* of the protrusion 150*a* (similarly, the oscillating tooth 151 is provided with a hemispherical protrusion 151*a* with an abutment surface 151*b*).

At this point, by rotating the knob 123, one of the teeth of the axial set of teeth 104*a* will cause the oscillating tooth 150 to rotate by an amount sufficient to lower the hemispherical protrusion 150*a* so that the tab 152*b* of the pushbutton 152 passes beyond it and returns to the locking position with the aid, for example, of an elastic element, such as a spring, not illustrated for the sake of simplicity.

The rotation of the ring 104*a* simultaneously acts also on the oscillating tooth 151 to unlock the pushbutton 153 in a fully similar manner.

The operation of the device is as follows: by rotating the knob 123 clockwise, the pulley 139 is acted upon and winds, for example, a cable connected to a foot presser until it reaches the desired degree of locking, which will be maintained by the action of the brake 154; by rotating the knob 123 in an anticlockwise direction, the drum 133 is rotated and winds, for example, a band for connecting the quarters of the boot, until it achieves the required degree of closure which is maintained by the brake 155.

In order to take the boot off it is sufficient to act on the pushbuttons 152 and 153 which release the brakes 154 and 155, allowing to open the quarters and release the presser.

The presence of the locking means offers the advantage of not having to keep the pushbuttons pressed, thus facilitating the operation.

When putting the boot on again, in order to achieve the locking of the quarters and of the presser it is sufficient to rotate the knob 123 in any direction to return the pushbuttons into the position of locking of the respective brakes and then tighten the presser and the quarters as preferred by acting on the knob 123 in the desired manner.

Figure 8:
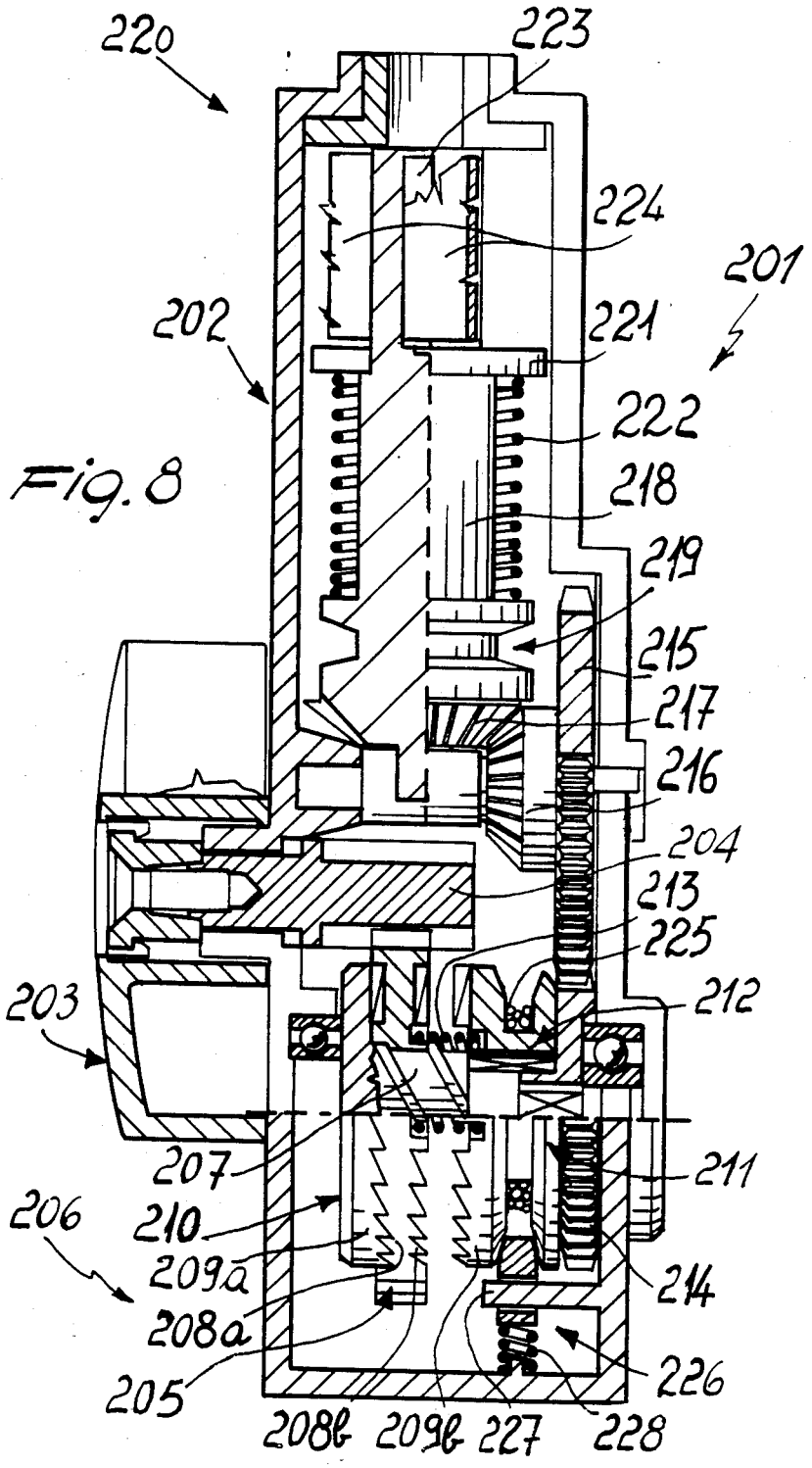
FIG. 8 is a lateral elevation view, in cross section, of a device according to yet another aspect of the invention with the switching means in such a position as to actuate the first winder.
Figure 9:
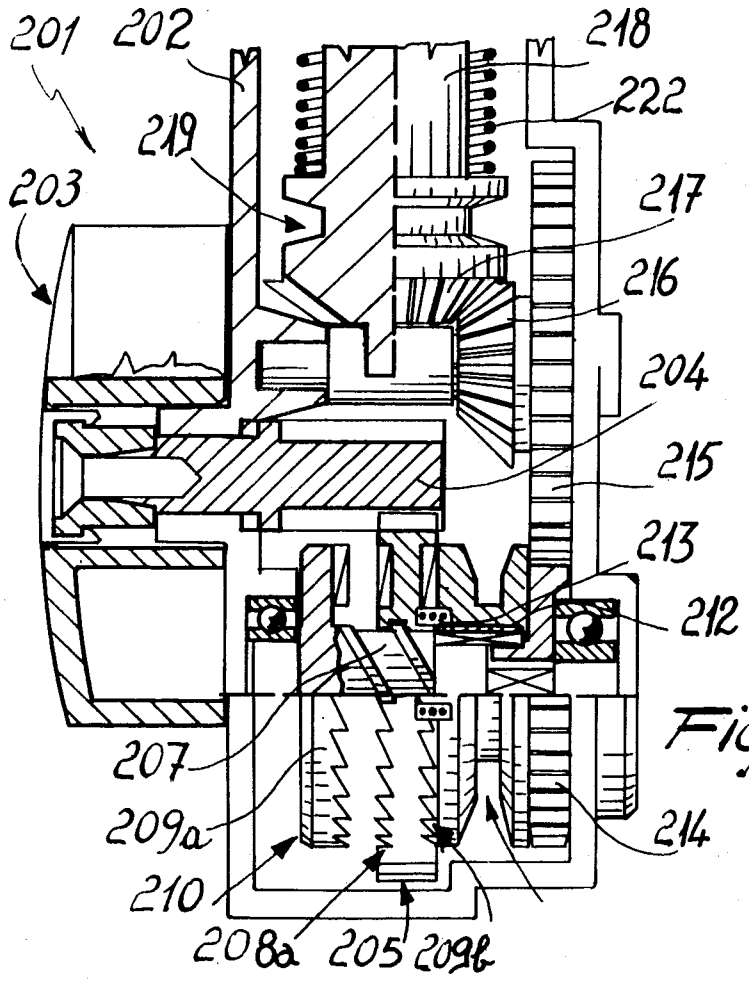
FIG. 9 is a partial view, similar to the preceding one, of the device with the switching means arranged so as to operate the second winder.

With reference to FIGS. 8 and 9, a multiple-function actuation device 201 is illustrated which is applicable, for example, to the rear region of the rear quarter of a boot.

The device 201 comprises a containment body 202 with which is rotatably associated a knob 203 provided with a drive shaft or pinion 204. The pinion 204 engages with a first movable toothed wheel 205 which has an axis parallel to that of the pinion and is arranged at the lower end 206 of the containment body 202.

Said wheel is keyed to an endless screw 207 and is provided, on both lateral surfaces, with sets of teeth 208*a* and 208*b* respectively interacting with complementarily shaped sets of teeth 209*a* and 209*b* respectively of a second wheel 210 and of a pulley 211 which face them.

While the teeth 210 is keyed at an end of the endless screw 207, the pulley 211 is free with respect to the latter, since a roller bearing 212 is interposed between them.

A cylindrical helical compression spring 213 arranged coaxially with respect to the endless screw 207 interacts between the facing surfaces of the movable toothed wheel 205 and of the pulley 211, said spring forcing, at rest, said first wheel 205 to interact with said second wheel 210.

A third toothed wheel 214 is rigidly associated with the endless screw 207 at the opposite end with respect to the wheel 210, and transmits the rotary motion imparted thereto to a fourth toothed wheel 215 whereto is keyed a first bevel gear 216 which transmits the motion to a second bevel gear 217 rigidly associated with a winder.

The latter is, for example, composed of a shaft 218, essentially cylindrical in shape, rotatably associated inside the containment body 202 and arranged along a longitudinal axis which is perpendicular to that of the pinion 204.

Adjacent to the second gearwheel 217, the shaft 218 is provided with an annular groove 219 and, proximate to the upper end 220 of the containment body 202, with an annular ridge 221, between the latter and the groove 219 there being provided a spring 222 the ends whereof are associated with said containment body 202 and with said ridge 221.

The end of the shaft 218 which is rotatably associated with the containment body 202 is provided with a transverse through seat 223 for a band 224 insertable therein and adapted, for example, to provide the mutual closure of the quarters. The spring 222 has the per se known function of facilitating the first rewinding of the band 224 upon the closure of the quarters.

A cable 225, adapted for example to achieve the fastening of any pressers provided inside the boot, can instead be wound on the pulley 211.

A means for the releasable locking of the rotation in the direction of unwinding of said band and cable can be arranged at the annular groove 219 and in the groove of the pulley 211 and consists, for example, of a brake 226 of the type described above; for the sake of simplicity the brake applicable to the groove 219 is not illustrated in the figures.

The brake 226, eccentrically pivoted to a pivot 227 which protrudes inside the containment body 202 and whereon acts the spring 228, allows the accommodation of the cable 225 preventing its unwinding. An adapted lever, not illustrated in the figure and adapted to allow the unwinding of the cable 225, is furthermore associable with the brake 226.

The operation of the device is as follows: at rest, the first toothed wheel 205 interacts with the second wheel 210.

Thus, by rotating the knob 203 in a clockwise direction, by virtue of the orientation of the thread of the endless screw 207 the interaction between said first wheel 205 and said second wheel 210 is maintained, the latter wheel transmitting the motion to the third wheel 214 and then to the fourth wheel 215 and finally, by means of the conical gears 216 and 217, to the shaft 218.

The winding of the band 224 and therefore, for example, the fastening of the quarters are thus achieved.

During this phase the pulley 211 is inactive, since it is freely mounted on the roller bearings 212.

If instead an anticlockwise rotation is imparted to the knob 203, an axial translatory motion is imparted to the first toothed wheel 205 until it interacts with the set of teeth 209*b* of the pulley 211, in said step the spring 213 being compressed.

The subsequent rotation imparted again in the same direction to the knob 203 thus allows the user to wind the cable 225 on the pulley 211, thus achieving a second and separate function.

Figure 10:
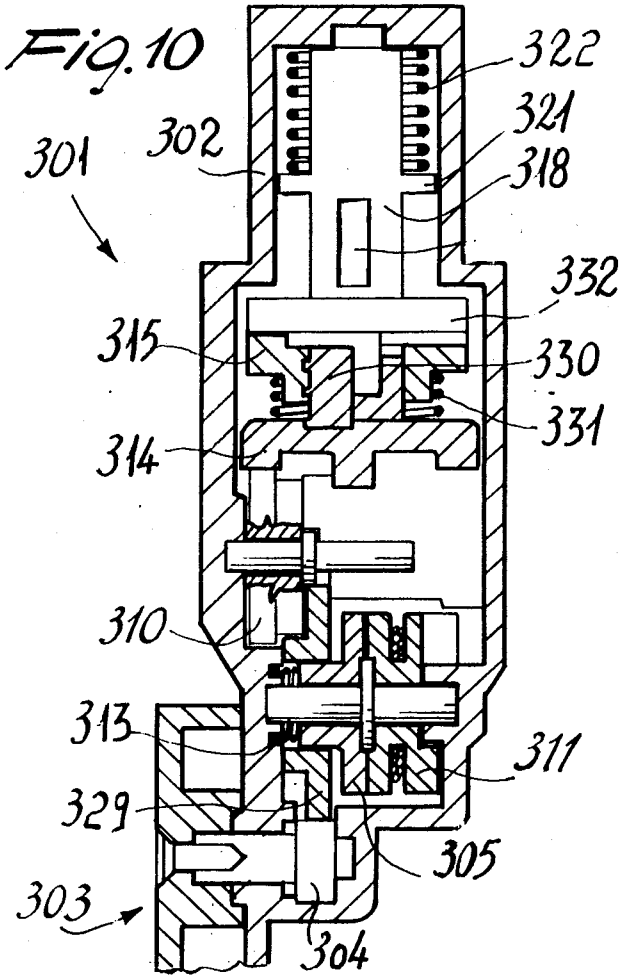
FIG. 10 is a lateral elevation view, in cross section, of a device according to a further aspect of the invention.

FIG. 10 illustrates a multiple-function actuation device 301, according to yet another aspect of the invention, comprising a containment body 302 which rotatably supports a knob 303 which actuates a pinion 304 interacting with a traction wheel 329.

The latter is axially provided with a helical set of teeth adapted to impart an axial translatory movement to a first movable toothed wheel 305.

At rest, the latter is forced, by means of an adapted spring 313, to mesh with a facing pulley 311 which is freely keyed on the same axis.

The wheel 329 transmits the motion to a second wheel 310 which in turn transmits it to a third wheel 314 provided with an axis which is perpendicular to that of the pinion 304.

Said third wheel 314 is provided with an outwardly threaded axis 330 so as to impart an axial movement to a fourth toothed wheel 315 which thus moves axially with respect to the axis 330.

A spring 331 is arranged coaxially with respect to the wheel 315 and is adapted to facilitate the axial movement of the wheel in the opposite direction.

Said wheel 315 is in fact provided with a set of teeth facing a complementarily toothed fifth wheel 332 perpendicular whereto is rigidly associated a winder consisting of a shaft 318 whereon a transverse through seat 323 and an annular ridge 321 are provided, a spring being interposed between the latter and the base of the containment body 302 with which the shaft 318 is rotatably associated.

The arrangement of the various gears is such that upon a rotation in one direction of the knob 303 the coupling between the wheels 305 and the pulley 311 and the simultaneous uncoupling of the wheel 315 from the one 332 are achieved, so that one direction of rotation selects only one function.

By reversing the direction of rotation of the knob 303, the uncoupling of the wheels 305 from the pulley 311 and the coupling of the wheel 315 to the one 332 are achieved.

Figure 13:
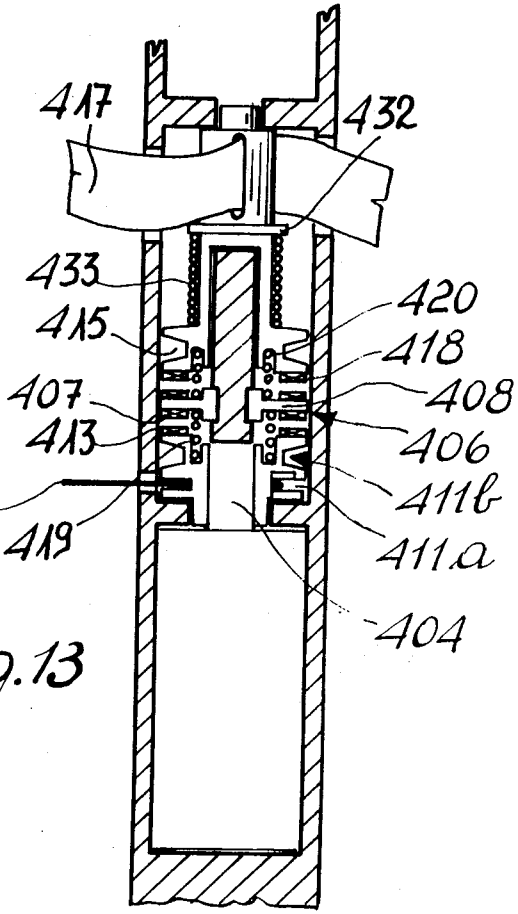
FIG. 13 is a cross section view along the line XIII—XIII of FIG. 11.
Figure 12:
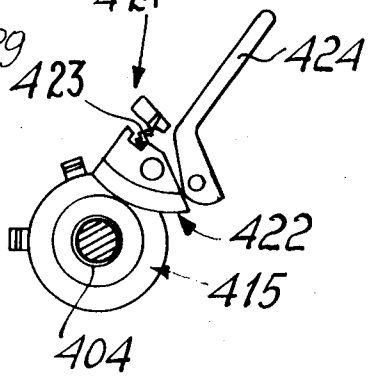
FIG. 12 is a view, along the line XII—XII of FIG. 11, of a detail of the removable locking means.
Figure 11:
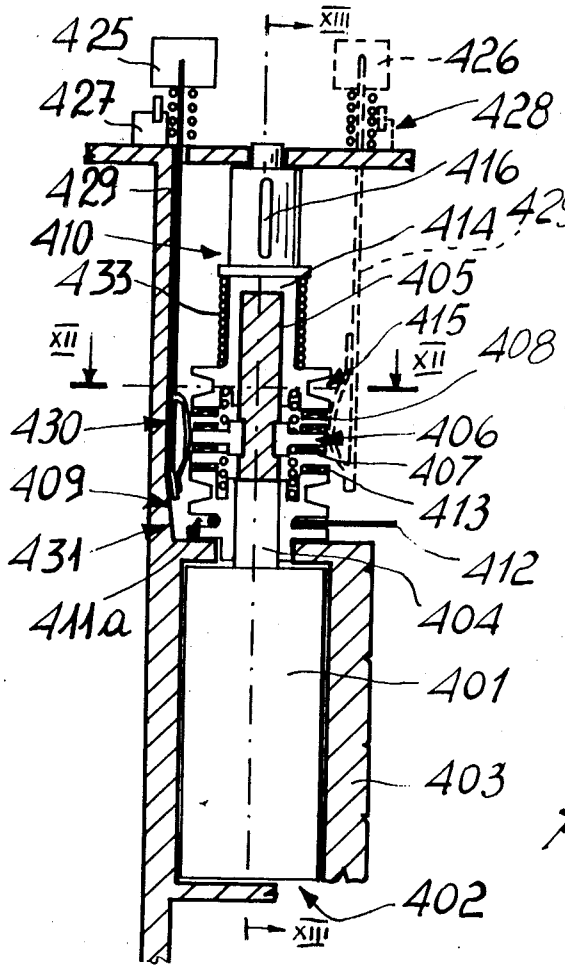
FIG. 11 is a lateral elevation view, in cross section, of a device according to still another aspect of the invention.

With reference now to FIGS. 11–13, a multiple-function actuation device is illustrated, according to a further aspect of the invention, comprising an electric motor 401 accommodated directly at an adapted seat 402 provided on a portion 403 of a ski boot, which is provided with a shaft 404 axially protruding therefrom and provided on the lateral surface with a partial thread 405.

A complementarily threaded wheel 406 is associated with said shaft 404 and is provided on both lateral surfaces with a first lower set of teeth 407 and with a second upper set of teeth 408.

A second winder assembly 409, arranged below the wheel 406, and a first winder assembly 410 arranged upwardly with respect to said wheel 406 are furthermore associated coaxially with respect to the shaft 404.

Both said first and said second winder assemblies do not draw their motion directly from the rotation of the shaft 404.

The second winder assembly 409 comprises a first and a second annular groove, indicated by the reference numerals 411*a* and 411*b* and arranged on a plane which is perpendicular to the axis of said shaft 404, acting as seats for a traction element such as a cable 412 and for a means for the releasable locking of the rotation in the direction of unwinding.

Said second winder assembly 409 is furthermore provided, facing said lower set of teeth 407 of said wheel 406, with a first complementarily shaped set of teeth 413.

The first winder assembly 410 consists of a cylindrical body 414 provided with an axial set for the shaft 404, at the ends whereof are provided a third annular groove 415 and a longitudinal through seat 416 for a traction element such as a band 417.

The end of said first winder assembly 410 which faces the upper set of teeth 408 of the wheel 406 interacts with the latter, said wheel being provided with a second complementary set of teeth 418 facing thereto.

The wheel 406 is thus interposed between the complementarily shaped sets of teeth 413 and 418, said wheel being able to mesh with the first set or with the second set depending on the direction of rotation imparted to the shaft 404 of the electric motor 401.

A first spring 419 and a seocnd spring 420 are provided coaxially with respect to the shaft 404 in order to keep the wheel 406 in such a position as to not interact at rest with the complementarily shaped sets of teeth 413 and 418, and are interposed respectively between the second winder assembly 409 and the wheel 406 and between the latter and the first winder assembly 410.

A means for the releasable locking of the rotation in the direction of unwinding can also be arranged at the third annular groove 415, said means consisting, for example, of a brake 421 of the type previously described.

Said brake in fact comprises lateral surfaces 422 which are forced to interact with the walls of the grooves by means of a third spring 423, the disengagement occurring by means of an adapted rod 424 which can be operated from outside.

The rotation at the shaft 404 of the electric motor 401 is selectively presettable by means of a remote control, not illustrated, or by means of manual devices applied directly to the boot 403 such as for example two pushbuttons 425 and 426.

In fact, by pressing one or two pushbuttons, a switch 427 or 428, adapted to actuate the rotation of the shaft 404 in the required direction, is closed.

Rods 429 are furthermore associated with each of the pushbuttons 425 and 426 and are adapted to ensure the translatory motion of the wheel 406 once a rotation is imparted to the shaft 404.

Said rods 429 are in fact provided at one end with friction springs 430, interacting with the perimetral edge of the wheel 406 and slideable along an inclined loading plane 431, which prevent the wheel 406, which is freely movable on the shaft 404, from rotating with the latter without performing any translatory motion if the friction produced by the first spring 419 and by the second spring 420 is insufficient. In the figures, only one of the rods 425 is illustrated, while the position of the other is schematically indicated in broken lines.

Conveniently, said pushbuttons 425 and 426 and therefore the rods 429 are not arranged on the same diametral plane.

Naturally, as to the power supply of the electric motor 401, the accommodation of accumulators is provided at the seat 402 or in any case in any point of the boot.

A fourth spring 433 is furthermore interposed between the third annular groove 415 and an annular ridge 432, outside the cylindrical body 414, and its ends are rigidly associated one to said cylindrical body and the other to a wall of the boot, the function of said spring being that of loading itself during the rotation imparted to the first winder assembly 410.

Thus, the use of the structure of a multiple-function actuation device is as follows: assuming that the cable 412 allows the tightening, for example, of a presser arranged inside the boot and that the band 417 allows the closure of the quarters, starting from the condition of closed quarters and secured foot the opening and the release are achieved by actuating the adapted means, such as the brakes 421.

By acting thus, the skier can move the quarters apart and move his foot, since the traction element can unwind from the respective winder assemblies which can rotate freely with respect to the shaft 404.

Instead, as to the closure of the quarters, the skier initially moves them closer manually, the takeup of the band 417 occurring by virtue of the preloading of the third spring 433.

In order to achieve the final securing, the user merely has to press the pushbutton 426 which actuates the rotation of the shaft 404 of the electric motor 401 so as to have the upper set of teeth 408 of the wheel 406 interact with the second complementarily shaped set of teeth 418 rigidly associated with the first winder assembly.

Naturally, the electric motor 401 is provided with an internal motor reducer having a safety clutch which opens the electric circuit when the load on the motor exceeds a specified value.

Once the lightening has been achieved, the spring 420 return the wheel 406 to its position so as to disengage it from the second complementarily shaped set of teeth 418.

At this point the skier can achieve the securing of the foot by actuating the switch 425 which actuates the rotation of the shaft 404 so as to have the lower set of teeth 407 of the wheel 406 interact with the first complementarily shaped set of teeth 413 rigidly associated with the second winder assembly 409.

It has thus been observed that the invention achieves the aim and the objects intended, a device having been obtained which is structurally very simple, has modest dimensions, and has a considerable comfort in use for the skier, since it is not needed to perform repeated actuations of levers or knobs in order to obtain the closure of the quarters and/or the securing of the foot and/or other required functions.

In fact, with the device according to the invention the different functions can be actuated by merely imparting a specific direction of rotation to the knob once.

This possibility allows the user an immediate sensitivity to the activated function, since he need not perform selections and subsequent actuations.

The device is furthermore structurally compact and therefore easily supportable by a ski boot.

Naturally, the invention thus conceived is susceptible to numerous modifications and variations, all of which are within the scope of the same inventive concept.

Naturally, the materials and the dimensions of the individual components of the device may also be any according to the specific requirements.

We claim:

1. Multiple-function actuation device particularly for ski boots, comprising a containment body associable with a ski boot and supporting an actuation assembly for the actuation of at least two traction elements each connected to at least one movable element of said boot, characterized in that said actuation assembly actuates at least one drive shaft kinematically connected at least to a first winder and to a second winder for a traction element, kinematic switching means being provided to kinematically connect said actuation assembly alternately to said first winder and to said second winder, means being furthermore provided for the releasable locking of the rotation in the direction of unwinding of said first winder and of said second winder, wherein said acutation assembly actuates an inner shaft and an outer shaft coaxial to said inner shaft, said inner shaft being connected to a first toothed wheel connected by means of a bevel gear pair to said first winder, said outer shaaft being connected by means of gearwheels to said second winder, said first winder and said second winder being provided with mutually perpendicular axes of rotation.

2. Device according to claim 1, wherein said first toothed wheel defines, at its set of teeth, an annular groove adapted to engage with said locking means.

3. Device according to claim 1, wherein said actuation assembly comprises a base rotatably associated with said containment body and supporting at least a first fin and a second fin pivoted to said base and alternately interacting with an inner gearwheel rigidly associated with said inner shaft and with an outer gearwheel rigidly associated with said outer shaft, with said base there being associated a knob which can be accessed from outside and actuates said fins and said inner shaft and said outer shaft selectively.

4. Device according to claim 3, wherein said knob is provided with a neutral position with respect to said base wherein said inner shaft and said outer shaft are not kinematically connected to said actuation assembly.

5. Multiple-function acutation device particularly for ski boots, comprising a containment body associable with a ski boot and supporting an actutation assembly for the actuation of at least two traction elements each connected to at least one movable element of said boot, said actuation assembly actuating at least one drive shaft kinematically connected at least to a first winder and to a second winder for a traction element, kinematic switching means being provided to kinematically connect said actuation assembly alternately to said first winder and to said secodn winder, means being furthermore provided for the releasable locking of the rotation in the direction of unwinding of said first winder and of said second winder, wherein said actuation assembly comprises an electric motor having a drive shaft, selectively rotatable in opposite directions and actuating a toothed wheel which selectively engages said first winder and said second winder, said actuation shaft being provided with an outer threading adapted to engage with a similar threading of said toothed wheel for the axial translatory motion of said toothed wheel which is provided with a lower front set of teeth and with an upper front set of teeth, wherein said second winder facing said lower set of teeth and said first winder facing said upper set of teeth are freely associated coaxially to said shaft, wherein said second winder comprises a first annular groove and a second annular groove acting as seats respectively for a traction element such a cable and means for the releasable locking of the rotation in the direction of unwinding, said second winder being provided, at its end facing said lower set of teeth of said wheel, with a first set of teeth, and wherein said first winder consists of a cylindrical body provided at one end with a longitudinal through seat for a traction element, at its other end there being provided a third annular groove acting as seat for a further means for the releasable locking of the rotation in the direction of unwinding, said first winder being provided with a second set of teeth arranged facing the upper set of teeth of said wheel which is movable with respect to the shaft of said electric motor.

6. Device according to claim 5, wherein said lower set of teeth and said upper set of teeth of said wheel which is movable with respect to the shaft of said electric motor are kept, at rest, not interacting with said first set of teeth and with said second set of teeth by means of a first spring and of a second spring arranged coaxially with respect to said shaft and interposed respectively between said second winder and said wheel and between the latter and said first winder.

7. Device according to claim 6, wherein said first winder is provided, interposed between said third annular groove and an annular ridge protruding from said cylindrical body, with a fourth spring the ends whereof are respectively associated with said cylindrical body and with said containment body.

8. Multiple-function actuation device particularly for ski boots, comprising:

a containment body associable with a ski boot, at least two traction elements each connectable to a movable element of a ski boot, winders adapted for winding said traction elements and including at least one first winder and at least one second winder, said first winder and said second winder each defining a direction of winding and a direction of unwinding, drive shaft means kinematically connected to said first winder and said second winder, an actuation assembly supported by said containment body and being adapted for actuating said drive shaft means, means for operating said actuating assembly, kinematic switching means cooperating with said drive shaft means for kinematically connecting said actuation assembly alternately to said first winder and to said second winder, and brake means for independently releasably locking rotation of said first winder and said second winder at least in said direction of unwinding.

9. Multiple-function actuation device according device according to claim 8, wherein said first winder comprises a cylindrical body and a first annular groove rigidly associated with said cylindrical body, wherein said second winder has rigidly associated therewith at least one second groove, and wherein said brake means comprise, at least one brake adapted for frictional interaction with said first groove, at least one other brake adapted for frictional interaction with said second groove, first elastic means acting on said one brake and causing said one brake to interact with said first groove, second elastic means acting on said other brake and and causing said other brake to interact with said second groove, and means for selectively disengaging said one brake from said first groove and said other brake from said second groove.

10. Multiple-function actuation device according device according to claim 9, wherein said means for selectively disengaging said one brake from said first groove and said other brake from said second groove are adapted to be independently actuated by said actuation assembly.

11. Multiple-function actuation device according to claim 9, wherein said actuation means comprise arrester means adapted to maintain said acutation means in a position of release of said one brake from said first groove and said other brake from said second groove, and wherein said arrester means can be actuated by said actuation assembly to return said one brake to a position of engagement with said first groove and said other brake to a position of engagement with said second groove.

12. Mutliple-function acutation device according to claim 8, wherein said drive shaft means comprise at least one inner shaft and at least one outer shaft, said inner shaft being arranged coaxial to said outer shaft and connected to a first kinematic transmission means, said first kinematic transmission means being connected to said first winder, said outer shaft being connected to second kinematic transmission means, said second kinematic transmission means being connected to said second winder, said first winder having a first winder axis, said second winder having a second winder axis, said first winder axis and said second winder axis being arranged substantially perpendicular to each other.

13. Mutliple-function actuation device particularly for ski boots, comprising;

a containment body associable with a ski boot, at least two traction elements each connectable to a movable element of a ski boot, winders adapted for winding said traction elements and including at least one first winder and at least one second winder, said first winder and said second winder each defining a direction of winding and a direction of unwinding, drive shaft means kinematically connected to said first winder and said second winder, an actuation assembly supported by said containment body and being adapted for actuating said drive shaft means, power assisted means adapted for operating said actuating assembly, kinematic switching means cooperating with said drive shaft means for kinematically connecting said actuation assembly alternately to said first winder and to said second winder, and brake means for frictionally releasably locking rotation of said first winder and said second winder at least in said direction of unwinding, wherein said drive shaft means comprise at least one inner shaft and at least one outer shaft, said inner shaft being arranged coaxial to said outer shaft and connected to a first kinematic transmission means, said first kinematic transmission means being connected to said first winder, said outer shaft being connected to second kinematic transmission means, said second kinematic transmission means being connected to said second winder.

14. Multiple-function actuation device according device according to claim 13, wherein said first winder comprises a cylindrical body and a first annular groove rigidly associated with said cylindrical body, wherein said second winder has rigidly associated therewith at least one second groove, and wherein said brake means comprise, at least one brake adapted for frictional interaction with said first groove, at least one other brake adapted for frictional interaction with said second groove, first elastic means acting on said one brake and causing said one brake to interact with said first groove, second elastic means acting on said other brake and and causing said other brake to interact with said second groove, and means for selectively disengaging said one brake from said first groove and said other brake from said second groove.

15. Mutliple-function actuation device according device according to claim 14, wherein said means for selectively disengaging said one brake from said first groove and said other brake from said second groove are adapted to be independently actuated by said actuation assembly.

16. Multiple-function actuation device according to claim 14, wherein said actuation means comprise arrester means adapted to maintain said actuation means in a position of release of said one brake from said first groove and said other brake from said second groove, and wherein said arrester means can be actuated by said actuation assembly to return said one brake to a position of engagement with said first groove and said other brake to a position of engagement with said second groove.

17. Multiple-function actuation device according to claim 13, wherein said first winder has a first winder axis and said second winder has a second winder axis, said first winder axis and said second winder axis being arranged substantially perpendicular to each other.

* * * * *